US005100032A

United States Patent [19]

Burdorf et al.

[11] Patent Number: 5,100,032

[45] Date of Patent: Mar. 31, 1992

[54] RESERVOIR FOR COLLECTING DISSOLVED SOLID DETERGENT SOLUTION

[75] Inventors: Ronald E. Burdorf, Eagan, Minn.; John E. Thomas, River Falls, Wis.; Dale W. Groth, Edina; Lee J. Monsrud, West St. Paul, both of Minn.

[73] Assignee: Ecolab Inc., Saint Paul, Minn.

[21] Appl. No.: 588,659

[22] Filed: Sep. 26, 1990

[51] Int. Cl.[5] ..... B62D 5/40

[52] U.S. Cl. ..... 222/377; 137/268; 222/65

[58] Field of Search ..... 222/56, 65, 377; 422/261, 264, 266, 274, 277; 134/93; 137/268

[56] References Cited

U.S. PATENT DOCUMENTS

| | | | |
|---|---|---|---|
| 993,663 | 5/1911 | Dunham | 137/268 X |
| 2,193,897 | 3/1940 | Bobrick | 299/83 |
| 2,859,766 | 11/1958 | Shuldner | 137/268 |
| 3,332,871 | 7/1967 | Robinson | 422/261 X |
| 3,850,344 | 11/1974 | Burge et al. | 422/266 X |
| 4,361,163 | 11/1982 | Aigo | 134/199 |
| 4,444,730 | 4/1984 | Renders et al. | 422/264 |
| 4,601,300 | 7/1986 | Sundheimer | 134/111 X |
| 4,753,781 | 6/1988 | Cassady, Jr. et al. | 422/264 |
| 4,770,859 | 9/1988 | Heiser, Jr. | 422/264 |

FOREIGN PATENT DOCUMENTS

| | | | |
|---|---|---|---|
| 523117 | 4/1931 | Fed. Rep. of Germany | 137/268 |
| 3510831 | 10/1986 | Fed. Rep. of Germany . | |
| 3722867 | 1/1989 | Fed. Rep. of Germany . | |
| 1402493 | 5/1965 | France . | |
| 1431705 | 10/1988 | U.S.S.R. | 137/268 |

*Primary Examiner*—Kevin P. Shaver
*Assistant Examiner*—Joseph A. Kaufman
*Attorney, Agent, or Firm*—Merchant, Gould, Smith, Edell, Welter & Schmidt

[57] ABSTRACT

Disclosed is a dispenser (10) for dispensing a wash chemical solution which has been created by dissolving a solid wash chemical (65) in a diluent. The dispenser (10) has a sump (48) which is positioned beneath an outlet port (40) for the wash chemical solution, so that the sump (48) collects the dissolved wash chemical. The sump (48) is contained within a reservoir (17), and overflow from the sump (48) is collected within the reservoir (17). A pick-up tube (27) withdraws the wash chemical solution from the reservoir (17). The sump (48) is retained within the reservoir (17) by flexible tabs (72) and a support member (51) against which the sump (48) is positioned. A screen is provided above the sump (48) for filtering unwanted particulates.

15 Claims, 3 Drawing Sheets

FIG. 1
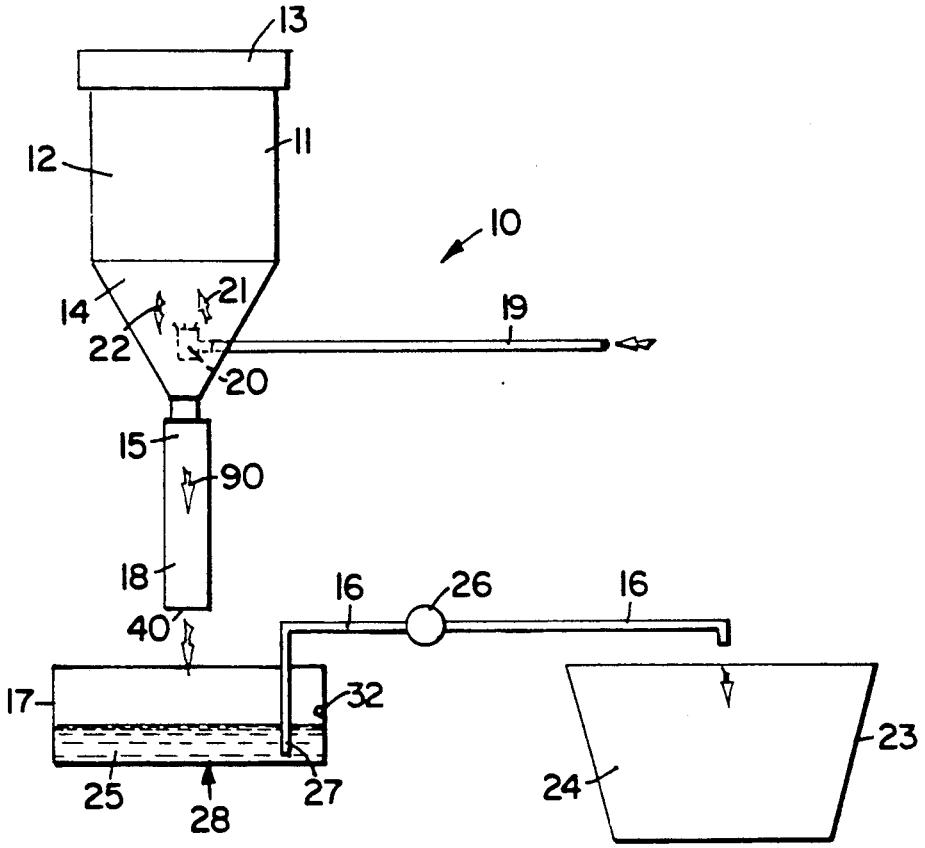
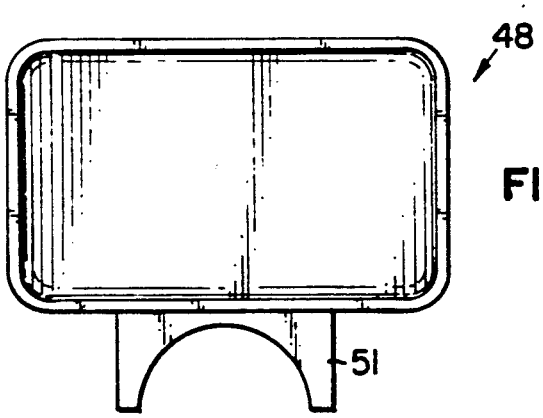
FIG. 4
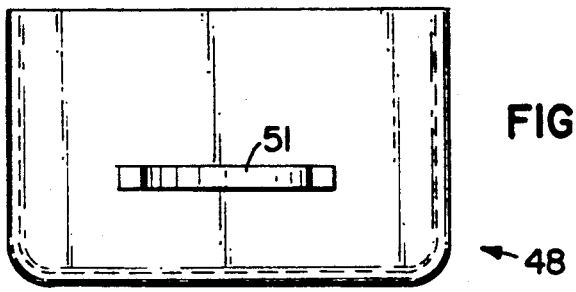
FIG. 5

RESERVOIR FOR COLLECTING DISSOLVED SOLID DETERGENT SOLUTION

FIELD OF THE INVENTION

The present invention relates generally to dispensers for products such as solid detergents, and more particularly to a dispenser having a unique two-compartment sump design.

BACKGROUND OF THE INVENTION

A number of different techniques have been developed and used for converting a solid cleaning composition into a concentrated cleaning solution. Such wash chemicals include detergents, rinse aids, and the like. The solid detergent product may be contained within a capsule, with only a portion of the detergent block being dissolved with each cycle. The detergent is dissolved by the impingement of a diluent upon the detergent block, the diluent typically being water. The concentrated detergent solution formed by the action of the water falls by gravity into an underlying reservoir, or is directed by a conduit to the wash tank of the washing apparatus.

Utilization of solid cleaning compositions has several advantages over the use of pre-mixed liquid cleaning compositions. These advantages include the fact that the solid detergent is easier and cheaper to ship due to its greatly-reduced weight; the solid detergent requires less storage space; and the solid detergent allows for a safe work environment by reducing possible splashing of hazardous chemicals. Overall, the solid detergent is more convenient for the user, and it permits easy transfer from a container to a dispenser, involving no pouring, spilling or leftover product.

Often, an appropriate amount of new cleaning solution is created for each cleaning cycle. Alternatively, a solid detergent dispenser may utilize a "surge" or reservoir compartment to hold the concentrated solution. The reservoir compartment holds enough concentrated solution for a plurality of machine cycles, with the time between cycles varying greatly depending upon the user's particular demands. That is, the reservoir compartment may be completely emptied and refilled repeatedly during the day, with a cycle occurring as often as every two minutes, or the filled reservoir compartment may sit unused overnight.

The problem with such a reservoir system is that the cleaning solution within the reservoir tends to develop stratification or concentration gradients. More specifically, the detergent concentration near the bottom of the reservoir may be, for example, approximately 25%-40%, with the concentration in the upper part of the reservoir being 6%-11%. This stratification may result from several factors, including an uneven dissolution rate of the solid detergent, a lack of turbulence in the reservoir, and/or a continual drip of the solid cleaning product into the sump after the dispensing cycle has been completed.

The cleaning solution is typically withdrawn from the bottom of the reservoir and is therefore the most concentrated product. Consequently, the concentration of the withdrawn cleaning solution is often too high. The dispensing system's pump, flow lines, and flow control components such as valves may become clogged and inoperable. Even if the clogging problem is avoided, there is a waste of the cleaning product, which can prove costly for the user. Overuse of the product also results in less than optimal cleaning capabilities, because an improper amount of detergent is being dispensed.

The present invention addresses these and many other problems associated with currently available dispensers.

As used herein, the term "utilization point," when used in combination with a wash chemical solution, refers to the place where the solution is used, such as a wash tank, a rinse spray nozzle, a pressurized water line, etc.

As used herein, the term "wash chemical" refers to those chemical components or chemical mixtures commonly added to aqueous liquids present in the machine washing units to aid in the cleaning and rinsing of fabrics and wares. Such wash chemicals include detergents, softeners, bleaches, rinse aids, etc.

SUMMARY OF THE INVENTION

The present invention comprises an apparatus for dispensing a wash chemical solution which has been created by dissolving a solid wash chemical in a diluent. The dispenser has a sump which is positioned beneath an outlet port for the wash chemical solution, so that the sump collects the dissolved wash chemical. The sump is contained within a reservoir, and overflow of the wash chemical from the sump is collected within the reservoir. A pick-up tube is positioned so as to withdraw the wash chemical solution from the reservoir and transport it to the point of usage. In the preferred embodiment, the sump is contained within the reservoir by retention means, such as flexible tabs and a support member against which the sump is positioned. Preferably, a screen is provided above the sump for filtering unwanted particulates.

A particular advantage of the present invention is the elimination or substantial reduction in the concentration stratification within the reservoir. It has been determined that the present invention reduces stratification, so that the concentration measurement in the upper portion of the reservoir is approximately 9%-10%, with the bottom measurement being only slightly higher at approximately 11%-16%. This reduction in stratification results in a cleaning solution which has a more consistent concentration, thereby reducing the likelihood that a pump or other flow control device would become clogged. By providing for the consistent dispensing of the proper, concentration, product waste is also minimized, and the cleaning product can be used to its optimum capabilities.

Another advantage of the present invention is its simplicity of construction and ease of manufacture. The present invention is relatively low in cost, and it is modular in construction so that the entire assembly need not be replaced in the event that a portion of the assembly breaks. The inventive sump is also easy to clean, thereby facilitating maintenance of the dispensing assembly.

For a better understanding of the invention, and of the advantages obtained its use, reference should be made to the drawings and the accompanying descriptive matter in which there is illustrated and described a preferred embodiment of the invention.

BRIEF DESCRIPTION OF THE DRAWINGS

Referring particularly to the drawings, wherein like reference numerals indicate like parts throughout the several views:

FIG. 1 is a schematic block diagram of the dispensing system of the present invention;

FIG. 4 is a plan view of the sump which is utilized with the reservoir illustrated in FIG. 3; and FIG. 5 is a side elevational view of the sump illustrated in FIG. 4.

DETAILED DESCRIPTION OF THE PREFERRED EMBODIMENT

Figure 2:
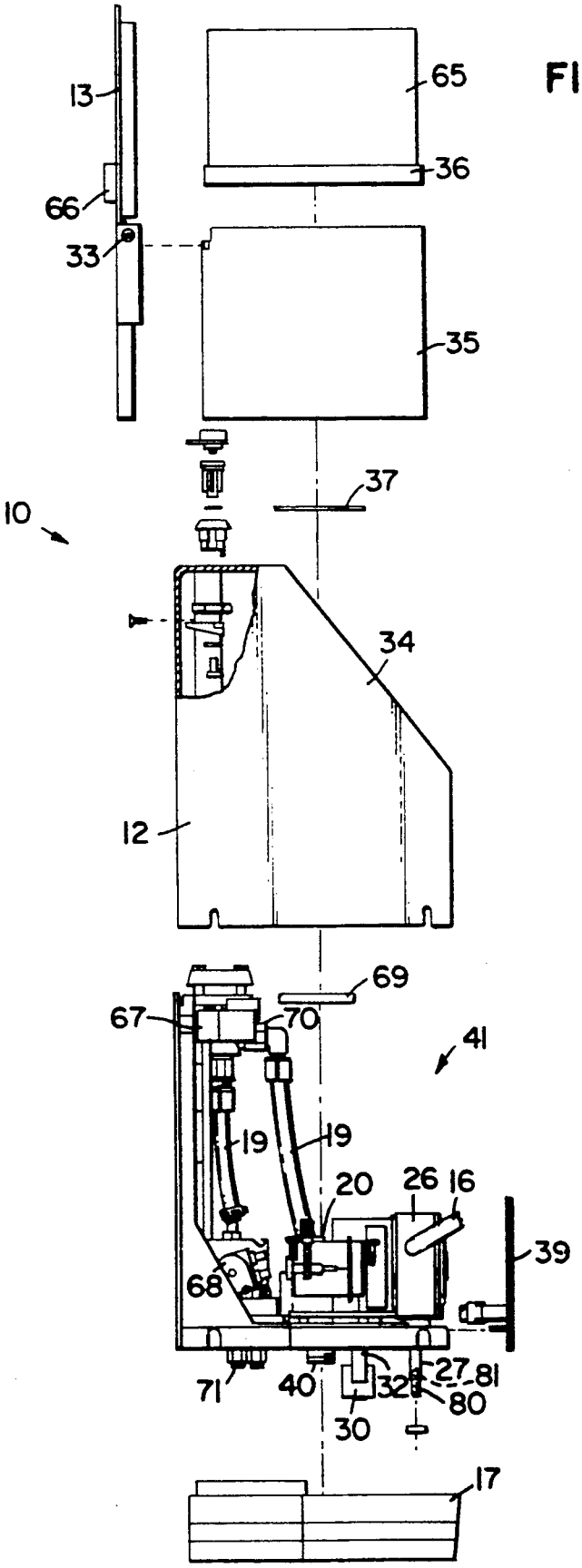
FIG. 2 is a side elevational exploded view of the dispenser of the present invention.

Referring to FIG. 1, a dispensing system is indicated generally at 10. The dispensing system 10 has a container or housing 11 with an upper storage portion 12 for holding a solid cleaning composition. A door 13 extends across the upper end of the storage portion 12 so as to provide access to the cavity within the storage portion 12. At the lower end of the container 11 is a collector portion 14. The lower end of the collector portion 14 defines an outlet port 15 for passage therethrough of solution collected by collector portion 14. Conduit 18 extends from the outlet port 15 to terminate at a position directly overlying the reservoir 17. The outlet port 15 directs the wash chemical solution downwardly as illustrated by the arrow 16 by gravity. If the wash chemical is not fed by gravity, a wash chemical solution pump (not shown) could be provided in the outlet conduit 18.

A water supply inlet pipe 19 is connected to the container 11 and is in communication therewith for providing a source of water flow to a spray-forming nozzle 20. The spray nozzle 20 directs water upwardly as shown by the arrow 21 so as to impinge upon the solid block of chemical, at which time the resulting liquid cleaning solution descends through the collector portion 14 as shown by the arrow 22.

Control of the dispensing of the wash chemical solution from the dispenser housing 11 is done by controlling the flow of water to spray nozzle 20. This may be done in a number of ways including mechanical means such as hydraulic timer valves and electrical means such as electrical switching in the control system (not shown) of the washing machine 23.

The dissolved cleaning solution 25 is collected within the reservoir 17 where it is available for use when necessary by the utilization vehicle 23. A supply conduit 16 transports the cleaning solution to the utilization vehicle 23, the supply pipe 16 having a pump 26 and other suitable flow control means. In the preferred embodiment, the pump 26 is a peristaltic pump. A pick-up tube 27 extends within the reservoir 17 proximate the bottom wall 28 of the reservoir 17 so as to withdraw the cleaning solution.

In the preferred embodiment, a float is positioned within the reservoir 17 and operatively connected to a float switch 32. The float switch 32 is operatively connected to spray control means such as a solenoid valve 68 for controlling the flow of water to the nozzle 20, so as to maintain a constant level of wash chemical solution in the reservoir 17. When the level of wash chemical solution in the reservoir 17 is below the desired constant level, the float switch 32 is electrically closed and the spray control means is opened so that additional wash chemical solution is formed until the float 30 returns to its desired level.

An exploded view of the dispenser assembly 10 is shown in FIG. 2. The dispenser 10 is preferably configured so that it can be mounted upon a wall near the wash machine 23. The container 12 preferably has a hood 34, the upper portion of which contains the housing 35 for the solid cleaning product 65 and the lower portion of which contains the flow control assembly 41. The hood 34 is preferably made of a stainless steel or molded plastic material. The size and shape of the housing 35 conforms with the size and shape of the solid product capsule 65 and is preferably cylindrical. A front panel assembly 39 is attachable to the front portion of the hood 34. The housing 35 is made of a clear or translucent plastic material, or contains a clear window, so as to indicate to the operator the level of solid wash chemical 65 contained therein.

The door 13 is connected to the container 12 by means of a hinge 33. In the preferred embodiment, there is a magnet 66 on the cover 13 which controls the opening and closing of a proximity switch 67. Opening of the cover 13 causes the proximity switch 67 to open and to turn off operation of the solenoid valve 68 which controls water flow. This provides a safety feature to prevent the operator's exposure to the wash chemical 65.

Grates 36 and 37 are preferably positioned below the solid detergent capsule 65, with the grate 36 having relatively large apertures and supporting the solid wash chemical 65. The grate 37 is positioned within the hood 34 and has relatively small apertures, on the order of one-half inch in diameter in the preferred embodiment, so as to trap undesirable particles from entering the wash chemical solution.

There is a seal 69 which serves as a divider between the wetted wash chemical portion of the dispenser 10 above the seal 69 and the electronic flow control assembly 41 below the seal 69. The seal 69 could be a U-cup, an O-ring or any other suitable configuration.

The water enters the dispenser's water supply line 19 at water inlet point 71. The water line 19 is provided with a vacuum breaker assembly 70 which prevents backflow of the wash chemical into the water supply line. The cleaning solution then exits into the reservoir 17 at outlet port 40. The wash chemical solution is withdrawn from reservoir 17 by means of the pick-up tube 27 and the pump 26. The cleaning solution is then directed to the utilization point 23 via conduit 16.

Figure 3:
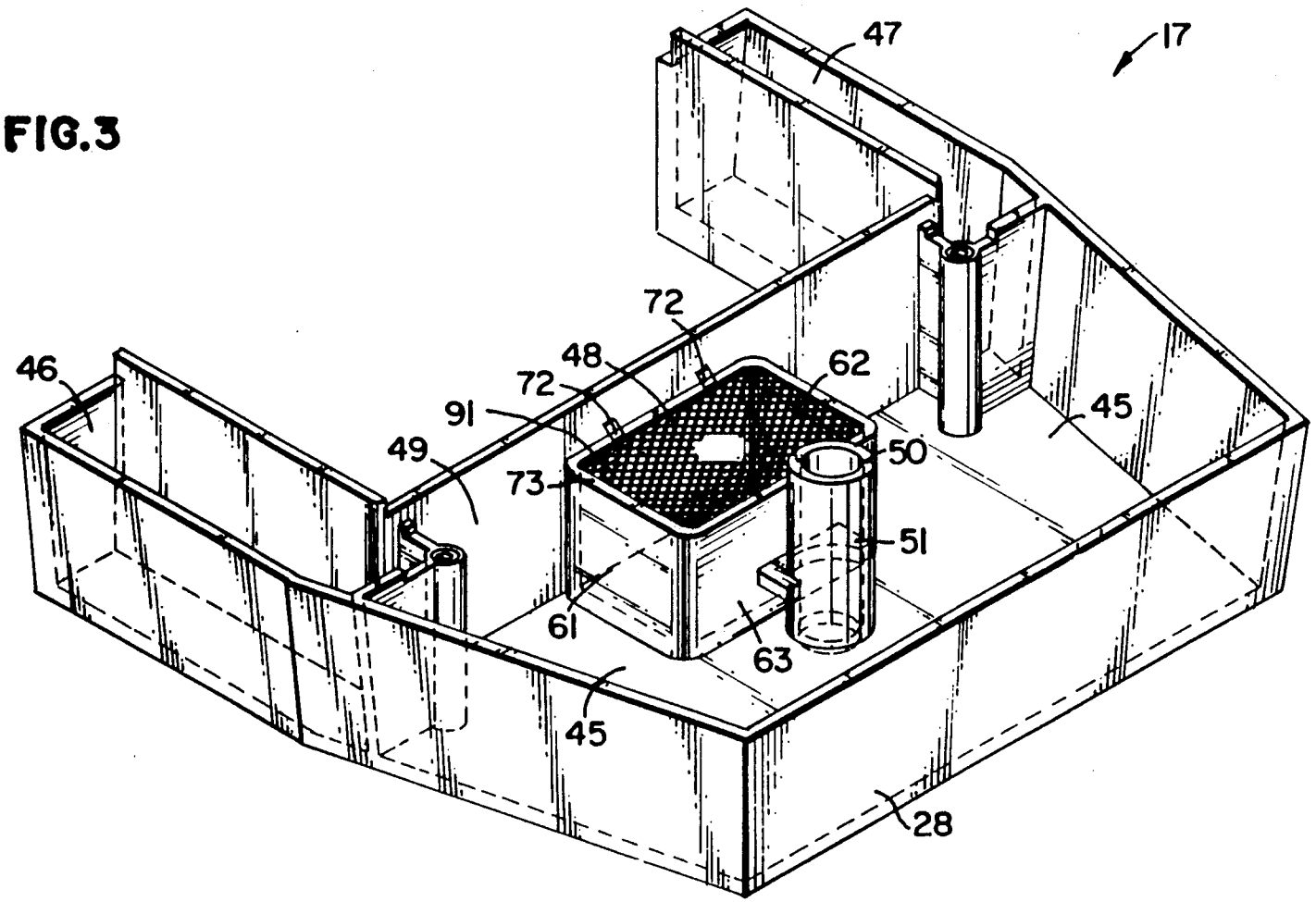
FIG. 3 is a perspective view of the reservoir utilized with the dispenser of the present invention.

At the lower end of the dispenser assembly 10 is the reservoir 17 which is illustrated in FIG. 3. The reservoir 17 includes a main cavity 45 in which the wash chemical solution is collected before it is transported to the point of utilization 23. A pair of side portions 46, 47 extend behind the cavity portion 45 and are attached to the bottom of the dispenser assembly 10 by suitable means. In the preferred embodiment, the reservoir 17 is made of a plastic material such as polymethylpentene or polypropylene, and is formed of a single, unitary piece. These types of plastic material are transparent and have resistance to heat and chemicals. Preferably, the reservoir 17 is made of a transparent or translucent material to allow the operator to see the amount of wash chemical in the reservoir 17.

The reservoir 17 includes a sump 48 within the cavity 45. The sump 48 is preferably positioned between a back wall 49 of the reservoir 17 and a cylindrical support member 50 which extends vertically from the bottom 28 of the reservoir. The sump 48 is preferably made of the same type of plastic material as the reservoir 17. In the preferred embodiment, the sump 48 is generally rectangular in shape with rounded corners to facilitate cleaning. As shown in FIGS. 4 and 5, the sump 48 includes an integral semi-circular positioning member 51 which accommodates the cylindrical support member 50 so as to properly position the sump 48 within the reservoir 17.

Retention means are provided to hold the sump 48 in place. In the preferred embodiment, the retention means includes a pair of tabs or detents 72. The tabs 72 are attached to the back wall 49 of the reservoir 17 and are flexibly movable between a position substantially flush with the back wall 49 and a retention position in which the tabs 72 extend away from the wall 49 so as to hold the upper surface 73 of the sump 48 in place. Thus, when the sump 48 is being returned to the reservoir 17 after cleaning, the tabs 72 are pushed flush with the wall 49, but the tabs 72 snap outwardly and into place when the sump 48 has been placed upon the bottom 28 of the reservoir 17. To remove the sump 48, the operator simply moves the tabs 72 so as to allow the sump 48 to be lifted from the reservoir 17.

In the preferred embodiment, there is a screen 91 which is permanently attached to the upper portion of the sump 48. The screen catches any debris, particulates or undissolved chunks of wash chemical 65 which would block the flow of the concentrated wash chemical solution out of the dispenser 10. The screen may extend only across the top opening of the sump 48, or it may also extend partially along the upper portion of the sump walls 61, 62, 63.

Positioned within the reservoir 10 is a pick-up tube 27. When cleaning solution is needed in the wash machine 23, the pump 26 is energized and cleaning solution is withdrawn from the reservoir 17 via the pick-up tube 27. The bottom of the pick-up tube 27 is positioned slightly above the bottom wall 28 of the reservoir 17, preferably approximately an eighth of an inch. The pick-up tube 27 is preferably made of a polypropelene material. The pick-up tube 27 contains a suitable flow indicator 80 such as one having a ball float 81, to enable the operator to visually monitor flow of the wash chemical from the reservoir 17.

The dispenser outlet 40 is positioned directly above the sump 48, so that the cleaning solution dispenses into the sump 48. Cleaning solution enters the main cavity 45 of the reservoir 17 and then it overflows over the side walls 61, 62 and front wall 63 of the sump 48. In the preferred embodiment, each dispensing cycle produces approximately 70 milliliters of liquid, which is dispensed into the sump 48. In the preferred embodiment, the volume of the sump 48 is approximately 60 milliliters. Therefore, the amount of cleaning solution generated during each dispensing cycle is slightly larger than the volume of the sump 48. As used herein, the term "dispensing cycle" refers to a single activation of the float switch 32. The switch may be activated more than once during a single cleaning cycle of the wash machine 23.

In the preferred embodiment, the volume of the reservoir 17 is enough for approximately five to ten cycles in the wash machine 23. By making up a quantity of wash chemical solution and storing it in the reservoir 17, the solution is immediately available whenever the cleaning system 23 calls for it.

Sufficient turbulence occurs in the sump 48 to cause mixing of the cleaning solution before it overflows to the reservoir 17. Mixing also occurs as a result of the sump solution overflowing into the reservoir, which creates a "waterfall effect." In this manner, a uniform solution is produced for dispensing to the utilization point 23. When the dispenser 10 feeds during its next cycle, the concentrated product is mixed and flushed out of the reservoir 17.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A dispenser of the type which dispenses a solution formed by dissolving a solid wash chemical in a diluent, comprising an outlet for delivering the solution; a sump positioned beneath said outlet for the solution, said sump collecting the dissolved wash chemical, said outlet being positioned above a level of solution in said sump; and a reservoir within which said sump is positioned, wherein overflow from said sump is collected in said reservoir.

2. The dispenser according to claim 1, wherein said sump includes screen means for filtering unwanted particles from said solution.

3. The dispenser according to claim 2, wherein said sump and said reservoir are made of a polymethylpentene material.

4. The dispenser according to claim 2, wherein retention means removably position said sump within said reservoir.

5. The dispenser according to claim 4, wherein said sump is generally rectangular in shape and has rounded corners.

6. The dispenser according to claim 5, wherein a volume of said sump is smaller than the amount of solution dispensed in a single dispensing cycle.

7. The dispenser according to claim 4, wherein said retention means comprises tab means proximate a top surface of said sump, and a support member against which said sump is positioned.

8. A dispenser of the type which dispenses a solution formed by dissolving a solid product in water, comprising:

a) a reservoir for storing the dissolved product, said reservoir having a pickup tube having an inlet positioned proximate a bottom wall of said reservoir;

b) a sump positioned within said reservoir so as to receive the dissolved product from a product source wherein a volume of said sump is smaller than the amount of solution dispensed in a single dispensing cycle; and c) a screen positioned proximate an upper portion of said sump.

9. The dispenser according to claim 8, wherein said sump and said reservoir are made of a polymethylpentene material.

10. The dispenser according to claim 9, wherein said sump is removably positioned within said reservoir by retention means.

11. The dispenser according to claim 10, wherein said sump is generally rectangular in shape and has rounded corners.

12. The dispenser according to claim 11, wherein said retention means comprises tab means proximate a top surface of said sump, and a support member against which said sump is positioned.

13. A dispenser which dispenses a certain volume of solution in a series of cycles, comprising:

a) a collector portion within which a solution is formed by the dilution of a solid product in a diluent, said collector portion including an outlet;

b) a reservoir within which the solution is stored, said reservoir including retention means;

c) a sump positioned within said reservoir and below said outlet by said containment means, said sump including a screen, a volume of said sump being smaller than the volume of solution dispensed in each dispensing cycle.

14. The dispenser according to claim 13, wherein said retention means comprises tab means proximate a top surface of said sump, and a support member against which said sump is positioned.

15. The dispenser according to claim 13, further comprising a pick-up tube having an inlet positioned proximate a bottom wall of said reservoir.

* * * * *